United States Patent [19]

Hukuhara

[11] Patent Number: 4,572,276

[45] Date of Patent: Feb. 25, 1986

[54] SCROLL MANUFACTURING TOOL

[75] Inventor: Seiichi Hukuhara, Gunma, Japan

[73] Assignee: Sanden Corporation, Gunma, Japan

[21] Appl. No.: 573,669

[22] Filed: Jan. 25, 1984

Related U.S. Application Data

[62] Division of Ser. No. 353,830, Mar. 2, 1982, Pat. No. 4,456,051.

[30] Foreign Application Priority Data

Mar. 2, 1981 [JP] Japan ..... 56-28312

[51] Int. Cl.[4] ..... B22D 17/26

[52] U.S. Cl. ..... 164/342

[58] Field of Search ..... 164/131, 137, 339, 340, 164/341, 344, 345, 342; 418/55

[56] References Cited

U.S. PATENT DOCUMENTS

| | | | |
|---|---|---|---|
| 801,182 | 10/1905 | Creux | 418/55 |
| 1,527,807 | 2/1925 | Loguin | 418/55 |
| 3,279,005 | 10/1966 | Wehmeyer | 164/137 |

FOREIGN PATENT DOCUMENTS

| | | | |
|---|---|---|---|
| 0648334 | 2/1979 | U.S.S.R. | 164/339 |

*Primary Examiner*—Nicholas P. Godici
*Assistant Examiner*—Richard K. Seidel
*Attorney, Agent, or Firm*—Banner, Birch, McKie & Beckett

[57] ABSTRACT

A tool for making a scroll for use in a scroll type fluid displacement apparatus is disclosed. The tool includes first and second molding members and an insertion member. The first molding element has an end plate and two involute wall elements extending from one side surface of the end plate to define two involute grooves, one wedge-shaped and the other rectangular in axial cross-section. A wedge-shaped insertion member is removably disposed in the wedge-shaped involute groove. The second molding member has an indentation in its axial end surface which defines an end plate of a scroll to be formed.

4 Claims, 6 Drawing Figures

SCROLL MANUFACTURING TOOL

This application is a division of application Ser. No. 353,830, filed Mar. 2, 1982, now U.S. Pat. No. 4,456,051.

BACKGROUND OF THE INVENTION

This invention relates to a scroll type fluid displacement apparatus, and more particularly to a method for manufacturing the scroll and a tool used in the method.

Scroll type fluid displacement apparatus are well known in the prior art. For example, U.S. Pat. No. 801,182 discloses a device including two scrolls, each having a circular end plate and spiroidal wrap or involute spiral element. Both scrolls are maintained at an angular and radial offset so that both spiral elements interfit at a plurality of line contacts between their spiral curved surfaces to thereby seal off and define at least one pair of fluid pockets. The relative orbial motion of the scrolls shifts the line contacts along the spiral curved surfaces to change the volume of the fluid pockets. The volume of the fluid pockets increases or decreases dependent on the direction of the orbital motion. Therefore, scroll type fluid displacement apparatus are applicable to compress, expand or pump fluids.

FIG. 1 illustrates a basic design of a scroll suitable for use in a scroll type fluid displacement apparatus. Scroll 1 includes a circular end plate 2 and a wrap or involute spiral element 3 affixed to or extending from one side surface of end plate 2. A scroll type fluid displacement apparatus includes a pair of such scrolls, both of which are maintained at an angular and radial offset so that they interfit and form a plurality of line contacts and axial contact to define at least one pair of sealed off fluid pockets. In such apparatus, each sealed off fluid pocket is defined by the line contacts between interfitting spiral elements and the axial contacts between the axial end surface of each spiral element with the inner end surface of the end plate of the other scroll. The volume of the fluid pocket is thereby defined by both line contacts and axial contacts.

The scroll is generally formed from a single piece of metal by a machining process, such as milling. However, a milling process consumes a great deal of time and energy and, also produces large quantities of waste metal. If the scroll member is formed by casting or forging, and axial dimension of the spiral element is to be made relatively long to obtain a large volume or higher capacity, the draft angle of mold must be made large. After forming in such a mold, the amount of machining of the spiral element to obtain uniform wall thickness increases with the result that relatively large quantities of waste metal are produced. Such a manufacturing method also consumes a great deal of time and energy and, makes it difficult to attain high accuracy of the wall dimensions of the spiral element.

SUMMARY OF THE INVENTION

It is a primary object of this invention to provide an improvement in a manufacturing method of a preformed scroll which is used in a scroll type fluid displacement apparatus.

It is another object of this invention to provide a manufacturing method of the preformed scroll which can reduce the production of waste metal during the finish machining operation of the scroll.

It is further a primary object of this invention to provide a manufacturing tool for forming a preformed scroll which is used in a scroll type fluid displacement apparatus.

It is another object of this invention to provide a manufacturing tool which achieves dimensional accuracy in the finish machining operation on the scroll in a time efficient manner.

A method for manufacturing a scroll for use in a scroll type fluid displacement apparatus according to this invention includes providing one molding member which has two involute grooves extending from one of its side surfaces. The axial cross-sectional configuration of the first involute groove is wedge-shaped and the axial cross-sectional configuration of the second involute groove is substantially rectangular-shaped.

An insertion member with wedge-shape mating cross-section is placed within the first involute groove to fill the space of the groove. A molten metal, which is to form the spiral element of the scroll, fills the second involute groove.

After the metal forms or hardens in the second groove, the insertion member is removed from the first involute groove and the formed metal is removed from the second involute groove. The scroll with rectangular cross-section spiral element is thereby attained.

Another aspect of this invention is to provide another second molding member which has a circular indentation at its axial end surface. The second molding member is secured on the end surface of first molding member to cover both involute grooves. The space of the indentation comprises a forming space. The metal which fills this forming space of the indentation forms the end plate of preformed scroll.

Still another aspect of this invention is that the first molding member has a plurality of holes each of which is placed on the locus of involute curve of the first groove. The holes connect between the bottom surface of first involute groove and opposite side surface of the end plate of first molding member. The insertion member has a plurality of pins at its axial end surface. When the insertion member is placed in the first involute groove, each of the pins penetrates each hole of the first molding member and the axial outer end portion of the pin extends from the hole. The insertion member is, therefore, easily removed from the first involute groove by pushing on the pins.

A manufacturing tool for use in the method of forming the scroll includes a first molding member which has an end plate and two involute wall elements. The two involute wall elements generally extend parallel to one another, so that two involute grooves are defined between the two involute wall elements. One of the two involute grooves has a wedge-shaped axial cross-sectional configuration and, the other involute groove has a substantially rectangular-shaped axial cross-sectional configuration. An insertion member is removably placed within one of two involute grooves. A second molding member has a circular indentation at one side surface facing the involute wall elements. The second molding member is placed on the first molding member and connected to the first molding member when casting of the molten metal occurs.

During molding of the metal, the rectangular-shaped groove in which the molten metal is disposed cannot expand, therefore, the formed or hardened metal which forms the spiral element of preformed scroll keeps the rectangular-shaped sectional configuration.

Another aspect of this invention is that a plurality of holes are formed in the end plate of first molding member and, a plurality of pins which axially project from the insertion member penetrate the holes. The removal of the insertion member is, therefore, easily accomplished by pushing the pins.

Further objects, features and other aspects of this invention will be understood from the following detailed description of preferred embodiment of this invention referring to the annexed drawings.

DETAILED DESCRIPTION OF THE PREFERRED EMBODIMENTS

Figure 2:
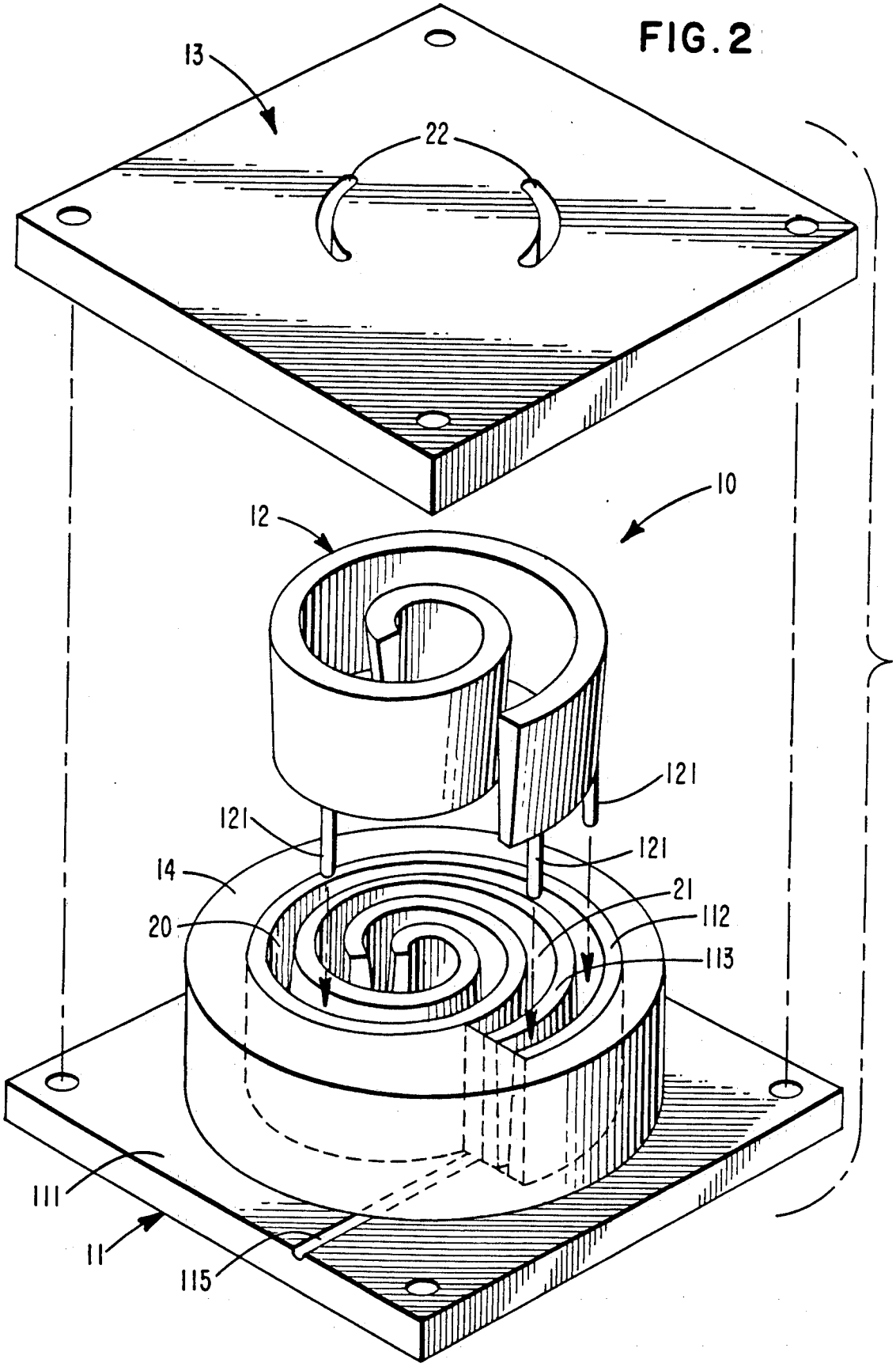
FIG. 2 is an exploded perspective view of the manufacturing tool according to the present invention.
Figure 3:
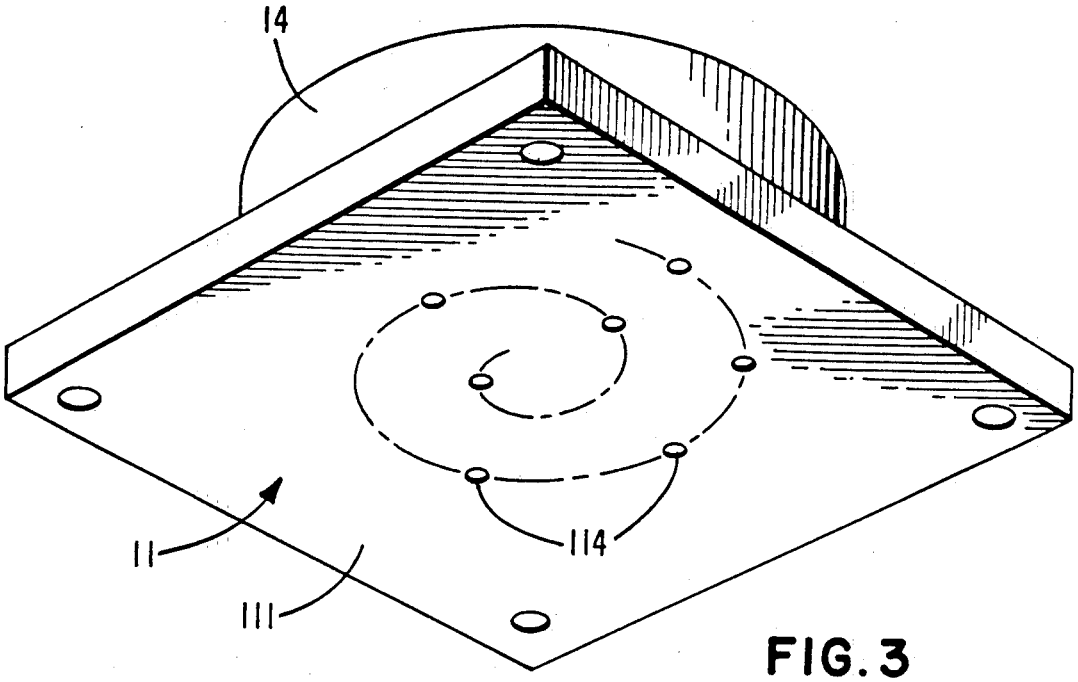
FIG. 3 is a perspective view of the first molding member used in the manufacturing tool of FIG. 2.

Referring to FIG. 2, a manufacturing tool 10 to form a scroll in accordance with the present invention is shown. The tool 10 includes a first molding member 11, an insertion member 12 and, a second molding member 13. First molding member 11 includes an end plate 111 and two involute wall elements 112, 113 affixed to or extending from one side surface of end plate 111. The second involute wall element 113 extends along the inner side surface of first involute wall element 112 with a space between them. Two involute grooves 20, 21 are, thereby, formed between the involute wall elements 112, 113. The outer side surface of first involute wall element 112 forms vertical surface and the inner side surface forms a tapered surface. The outer side surface of second involute wall element 113 also forms a tapered surface and the inner side surface forms vertical surface. An outer involute groove 20 is defined between the inner side surface of first involute wall element 112 and the outer side surface of second involute wall element 113. This outer involute groove 20 has a wedge-shaped axial cross-section with the narrow portion of the wedge-shape adjacent the end plate 111 and the broad portion of the wedge-shape adjacent the open end of groove 20. An inner involute groove 21 is defined between the outer side surface of first involute wall element 112 and the inner side surface of second involute wall element 113. The inner involute groove has a substantially rectangular-shape cross-section. A plurality of holes 114 are formed in end plate 111 and extend between the bottom surface of outer involute groove 20 and the opposite side surface of end plate 111. Each hole 114 is placed on the locus of the involute curve which defines outer groove 20, as shown in FIG. 3. A vent hole 115 is also formed through the end surface of end plate 111.

Insertion member 12 is placed in outer groove 20 during the forming of the metal in groove 21. The sectional configuration of insertion member 12 is substantially the same as that of outer groove 20, i.e., wedge-shape. Therefore, the open space of outer groove 20 is filled by insertion member 12. Insertion member 12 has a plurality of pins 121 axially projecting from one of its end surfaces, i.e., the end surface at its narrowed end. Each pin 121 penetrates a hole 114 and preferably the outer end portion of pins 121 extends outward from holes 114.

Figure 4:
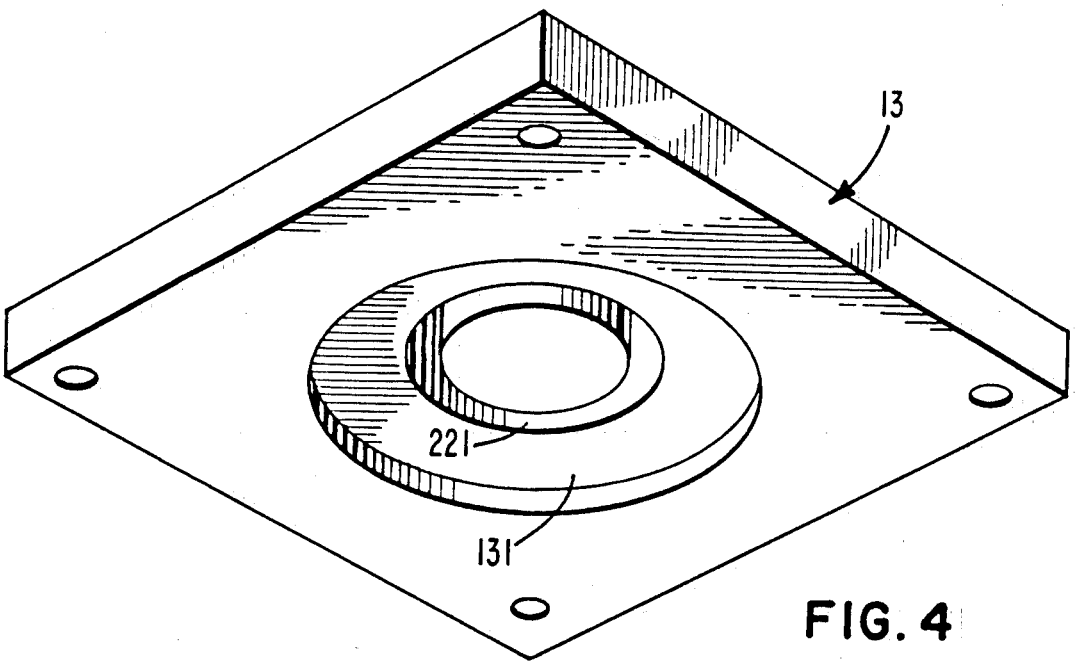
FIG. 4 is a perspective view of the second molding member used in the manufacturing tool of FIG. 2.

Second molding member 13 is placed over the first molding member 11 to close the opening space at the end of involute grooves 20, 21. The end surface of second molding member 13 which faces the first molding member 11 has a circular indentation 131, as shown in FIG. 4. The indentation 131 forms a molding space. A pouring opening 22 is formed through second molding member 13. In this embodiment, as shown in FIG. 2 and FIG. 4, two pouring openings 22 are formed in second molding member 13 and an annalar intermediate space 221 connects pouring openings 22 with indentation 131.

In this tool, a supporting member 14 extends from the outer side surface of the first involute wall element 112. When both molding members 11, 13 are connected by a fastner, such as bolts and nuts 15, the axial end surface of supporting member 14 is fitted against the end surface of second molding member 13. The predetermined axial distance between both molding members 11, 13 is, therefore, determined by the length of supporting member 14.

The casting or forging method using the above tool will be explained below.

As the first step, first molding member 11 and, insertion member 12 are provided. Insertion member 12 is placed in outer involute groove 20 and second molding member 13 is placed on the first molding member 11, Second molding member 13 is then connected to first molding member 11 by bolts and nuts 15.

Molten metal, such as aluminum, is poured into the space defined between both molding members 11, 13 through pouring opening 22. The space of inner groove 21 and molding space of indentation 131 are, therefore, filled with the molten metal which thereafter cools and solidifies.

During this time, the expansion of inner groove 21 due to the filling with and solidification of the molten metal is prevented by insertion member 12 in outer groove 20. Since the sectional configuration of inner groove 21 does not change, the sectional configuration of spiral element of formed scroll has a substantially rectangular-shaped cross-section. Furthermore, the molten metal which fills the molding space of indentation 131 forms the end plate of the scroll.

After solidification of the molten metal, the connection between molding members 11, 13 is released and, second molding member 13 is removed from first molding member 11. The outer end portions of pins 121 of insertion member 12, which extend from holes 114 of the first molding member 11, are then pushed out in the axial direction. Insertion member 12 is, thus, removed from outer groove 20. At the same time, solidified metal, i.e., the preformed scroll, is removed from inner groove 21, since, the axial end surface of insertion member 12 abuts against the end surface of end plate of the preformed scroll which was formed in the molding space of indentation 121. The preformed scroll is thus removed from inner groove 21 of first molding member 11 by removing the insertion member 12. Since the preformed scroll and insertion member 12 are removed from first molding member 11 at the same time, removal of preformed scroll member is readily acomplished. Because the open space of outer groove 20 becomes open during the removal of insertion member 12, involute wall element 112 which forms a partition between the outer and inner grooves can be readily bent, so that the space of the inner groove 21 might become larger.

Figure 1:
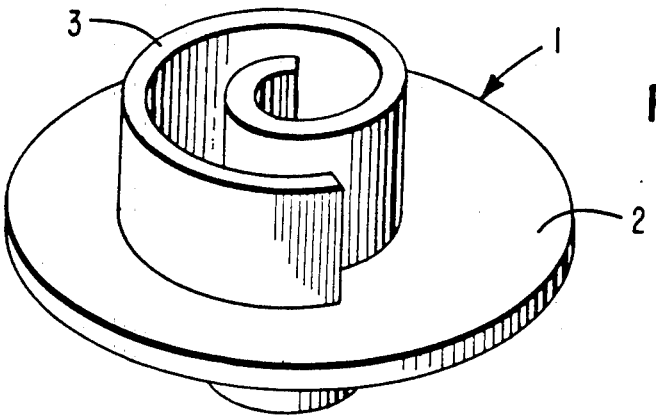
FIG. 1 is a perspective view of a scroll for use in a scroll type fluid displacement apparatus.
Figure 5:
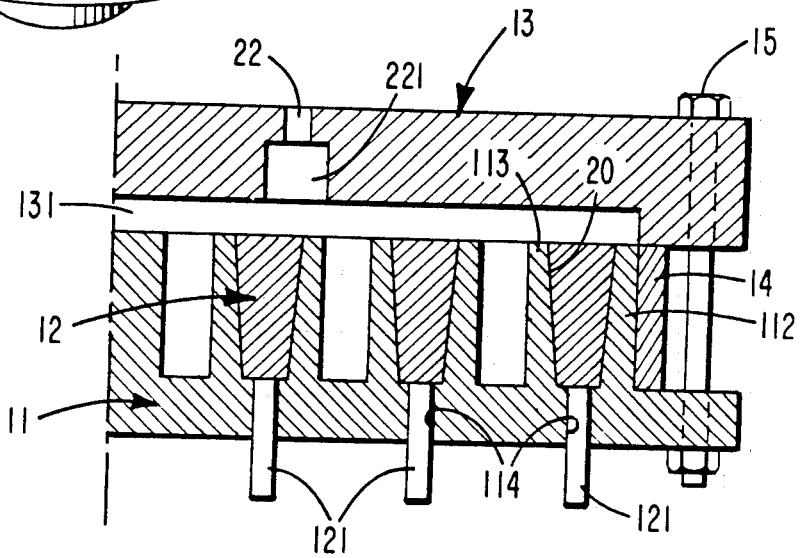
FIG. 5 is a sectional view illustrating a portion of the first and second molding members connected to one another.
Figure 6:
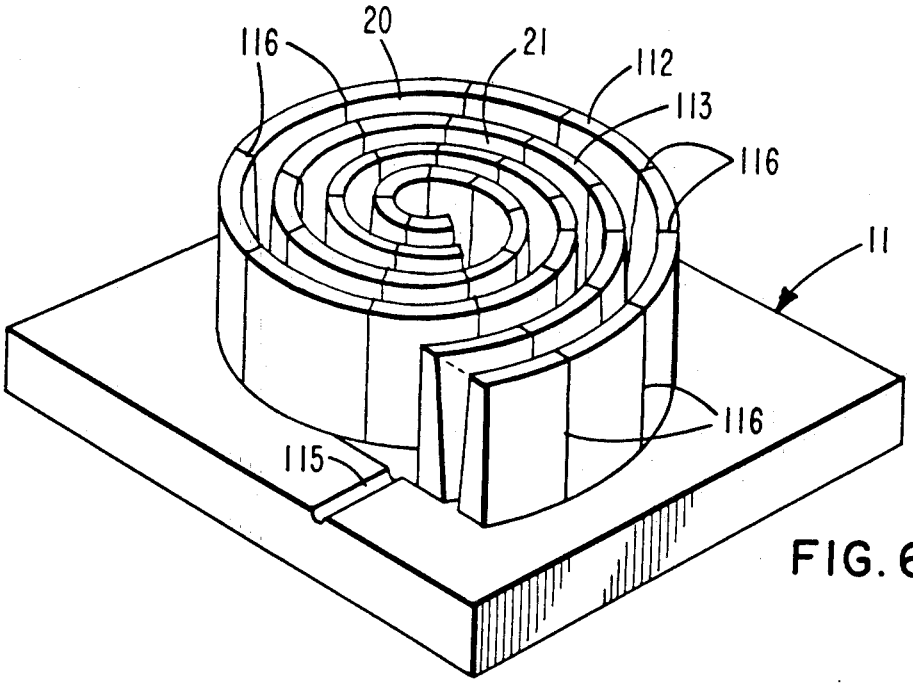
FIG. 6 is a perspective view of the first molding member according to another embodiment of the invention.

FIG. 6 shows another embodiment of manufacturing tool according to this invention, in which the involute wall elements are modified. The first and second involute wall elements 112, 113 have a plurality of slits 116 at predetermined suitable involute angles. Both involute wall elements 112, 113 are thus formed in a plurality of tongue-shaped portions. The removal of the preformed scroll is, therefore, made easier, since, each of tongue-shaped portions of involute wall elements has less rigidity and can be easily bent, however, with better elastic deformation properties so that the wall elements do not deform permanently out of shape.

The preformed scroll formed by above method and tool is machined in a finishing process, such as milling, to produce the final scroll which is used in the scroll type apparatus.

As described above, in this invention, the draft angle of the mold of spiral element portion can be minimized. The production of large quantities of waste metal during the finish working of the preformed scroll is thereby reduced. Furthermore, the time and energy for working of the final scroll is greatly reduced without adversely influencing the accuracy of spiral element dimensions.

This invention has been described in detail in the connection with the preferred embodiment, but this is an example only and the invention is not restricted thereto. It will be easily understood by those skilled in the art that other variations and modifications can be easily made with the scope of this invention.

I claim:

1. A manufacturing tool for making a scroll for use in a scroll type fluid displacement apparatus comprising:

(a) a molding member having an end plate and two involute wall elements extending from one side surface of said end plate to define two involute grooves having open ends opposite said end plate, a first of said two grooves having a wedge-shaped axial cross-sectional configuration, and a second of said involute grooves having a substantially rectangular-shaped axial cross-sectional configuration to define a space within which a spiral element of the scroll with a substantially rectangular axial cross-sectional configuration is formed;

(b) an insertion member having a wedge-shaped axial cross-sectional configuration mating with the axial cross-sectional configuration of said first involute groove removably disposed within said first involute groove; and (c) a second molding member having an indentation in its axial end surface facing said first and second involute grooves, said second molding member being secured over said first molding member during the manufacturing process to define a space within which an end plate of the scroll is formed.

2. The manufacturing tool of claim 1, wherein said first molding member has a plurality of holes which connect between a bottom surface of said first involute groove and the other end surface of the end plate of said first molding member and said insertion member having a plurality of pins each of which penetrates said holes.

3. The manufacturing tool of claim 1, wherein said two involute wall elements have a plurality of axial slits.

4. The manufacturing tool of claim 1, wherein said groove with the wedge-shaped configuration has its narrow end adjacent the end plate of said first molding member and its broad end adjacent the open ends of said two grooves.

* * * * *